United States Patent [19]

Moreau

[11] 4,288,061

[45] Sep. 8, 1981

[54] SAFETY BARRIER WHICH IS ESPECIALLY USEFUL FOR MOTORWAYS

[76] Inventor: Joël P. Moreau, 62, rue Paul Bert, 92150 Suresnes, France

[21] Appl. No.: 37,382

[22] Filed: May 9, 1979

[30] Foreign Application Priority Data

May 9, 1978 [FR] France ..... 78 13628

[51] Int. Cl.[3] ..... E04H 17/00

[52] U.S. Cl. ..... 256/13.1; 256/19; 256/1; 114/220

[58] Field of Search ..... 256/1, 13.1, 19; 114/219, 220; 404/6, 10

[56] References Cited

U.S. PATENT DOCUMENTS 2,413,210 12/1946 Blackman ..... 114/219
3,848,853 11/1974 Way ..... 256/13.1 X
3,880,404 4/1975 Fitch ..... 404/6 X
3,951,384 4/1976 Hildrith ..... 256/1
4,062,521 12/1977 Moreau ..... 256/1
4,118,014 10/1978 Frosch ..... 256/1

*Primary Examiner*—Andrew V. Kundrat
*Attorney, Agent, or Firm*—Brisebois & Kruger

[57] ABSTRACT

The disclosure relates to improvements in or relating to the safety barrier, especially for freeways, constituting the subject matter of U.S. Pat. No. 4,062,521.

Each module of the safety barrier comprises a casing 5 consisting of a stack of pneumatic tires 3 divided into units 6 and covered with a coating or outer covering 7, notches 8 being provided for the passage of the linear element or elements 2.

Especially useful for the safety of vehicles, particularly on freeways.

10 Claims, 4 Drawing Figures

SAFETY BARRIER WHICH IS ESPECIALLY USEFUL FOR MOTORWAYS

This invention relates to improvements in or relating to safety barriers, especially for freeways, constituting the subject matter of U.S. Pat. No. 4,062,521.

The safety barrier such as protected by the said U.S. patent is of the kind comprising a plurality of modules which are not tied down to the ground and are coupled to each other by at least one linear element which may be under tension and is characterized in that the said modules are composed of a material capable of bursting in response to an internal tension due to the said linear element or elements passing through the various modules and embedded in the mass of the latter, so that the module struck by a vehicle involved in an accident will burst, possibly together with the neighboring modules.

Advantageously, the said material comprises a mixture mainly consisting of a synthetic or natural plastic material and a binder, the said linear element or elements being formed by steel cables or ropes, or by link chains.

According to one preferred embodiment, the said material is composed of rubber obtained from the waste material of new and/or used pneumatic tires and the links in the said chains forming the linear elements come from the metallic belts of the said pneumatic tires.

The improvements constituting the subject matter of the present application increase the degree of reliability of the safety barrier described in the above mentioned U.S. patent.

In fact, the basic principle described in this patent is the absorption by the various modules of the energy generated by the impact following an accident, with the said modules bursting in response to an internal tension created by the linear element or elements. This bursting or disintegration, may be accompanied by an ejection of debris of the material constituting the said modules.

These fragments with a rubber and cement base are thus scattered mainly on the roadway, which must be avoided, or they may strike other vehicles, causing damage thereto.

The improvements constituting the subject matter of the present application is aimed at preventing these scattered fragments from being ejected.

More specifically, the safety barrier comprising the improvements of this application is characterized in that each module comprises a flexible casing which surrounds the said module and prevents any debris or fragments of materials from being ejected after the said module has been struck.

Advantageously, the casing is formed by casting.

Other advantages and characteristics of the present invention will be better understood from the consideration of the ensuing description offered by way of non-limitative example.

Figure 1:
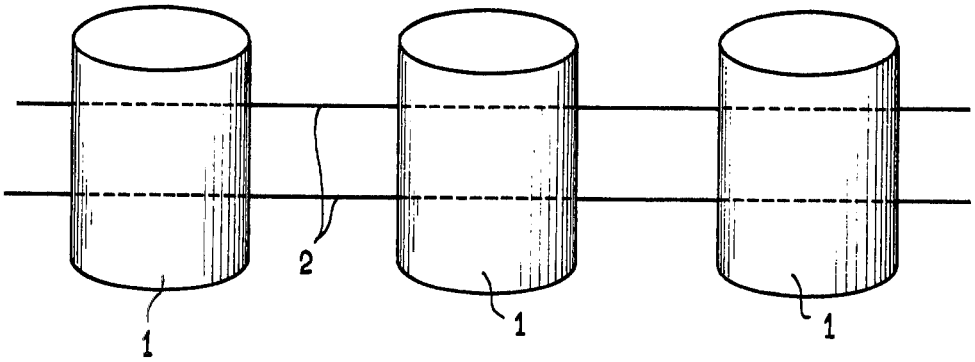
FIG. 1 is a schematic illustration of the safety barrier in accordance with the present invention.

In FIG. 1, the safety barrier is shown with its modules 1 connected by two linear elements 2 passing through the said modules and embedded in the mass of the latter.

Here, the modules 1 have a cylindrical form with a vertical axis, said shape being easy to obtain and offering additional safety because of the absence of vertical corners or edges.

Figure 2:
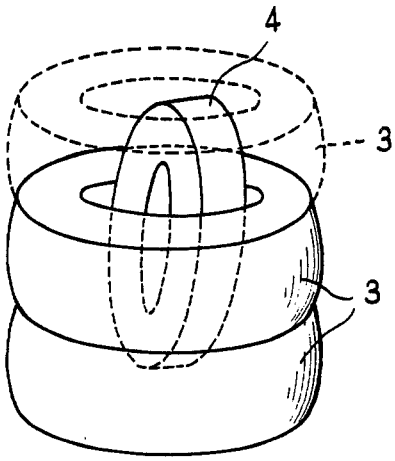
FIG. 2 shows the armature of the present invention.

FIG. 2 shows the improvements of the present invention consisting of a flexible casing surrounding each module and preventing projection of debris from the modules impact. Advantageously, this casing is made from pneumatic tires 3 (e.g. used) piled up in the manner shown in FIG. 2. Preferably, there will be placed within this stack an additional pneumatic tire 4 which is deformed, so that it can penetrate into the interior of the tires. It should be noted that in FIG. 2 the stack comprises two penumatic tires 3 shown in solid lines, a third tire 3 being shown in broken lines for reasons of clarity. In fact, it stands to reason that this stack will comprise a sufficient number of tires 3 to prevent tire 4 from passing beyond the said stack.

Advantageously, the exterior of said casing will be covered with a coating or covering made of fine powder consisting of pulverized rubber and a plastic binder.

Each module 1 provided with its casing will be prepared in the following manner:

(a) the tires will be "de-wired", that is to say, the metallic belts preferably constituting the linear element or elements will be removed therefrom;

(b) the "de-wired" tires will be piled up so as to obtain the above mentioned casing with the desired height, an additional pneumatic tire possibly being introduced into the said stack;

(c) depending on the preferred modification, the stack is externally covered with the coating comprising a mixture of pulverized rubber and a plastic binder. This operation is preferably carried out in a mold, which also permits a smooth outside appearance, the said mixture being colored or painted, as required;

(d) holes or notches are made in the casing and, if necessary, in the coating to allow the passage of the linear element or elements;

(e) the material constituting the module proper, such as described in U.S. Pat. No. 4,062,521, is then poured inside the casing.

Figure 3:
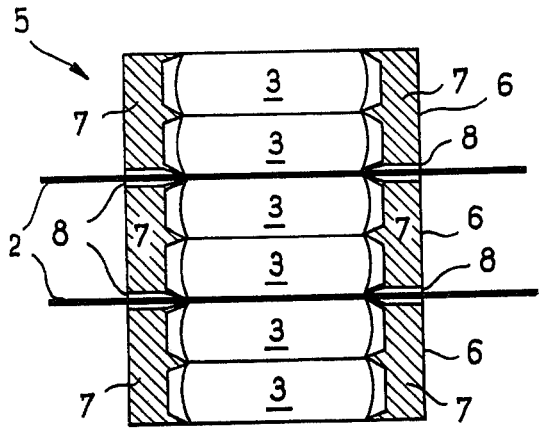
FIG. 3 is a cross-sectional view of a preferred embodiment of the flexible armature in accordance with the present invention.
Figure 4:
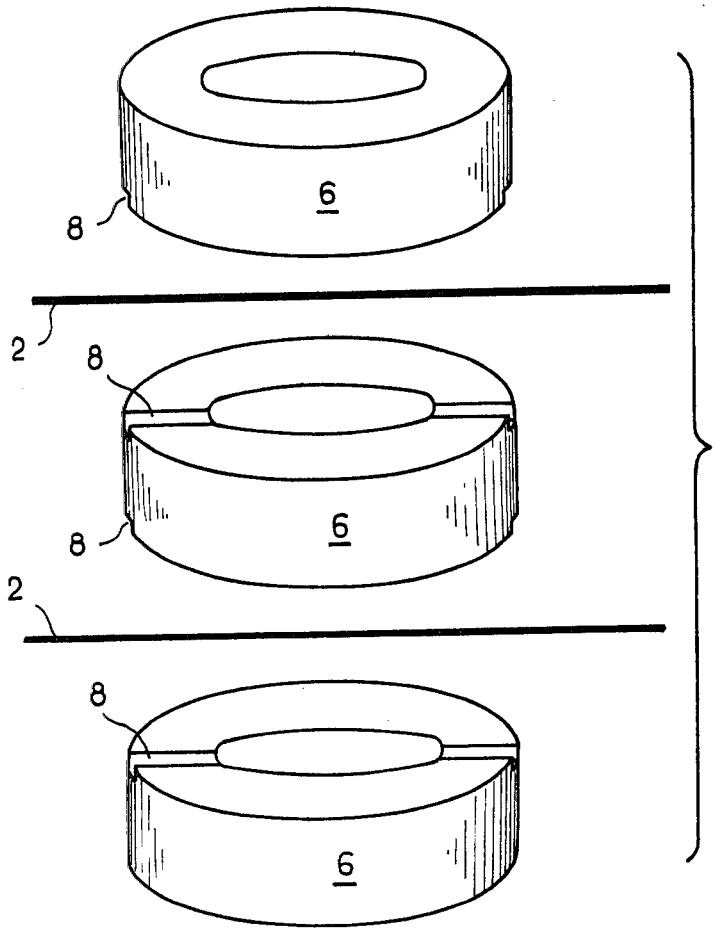
FIG. 4 is an exploded perspective view of the elements shown in FIG. 3.

FIG. 3 shows a preferred embodiment of the invention. It will be noted that the flexible casing, generally designated by the reference numeral 5, comprises at least two units 6, three units being shown herein. Each unit 6 is obtained in accordance with paragraphs (a), (b), (c), (d) above. Advantageously, each unit will be composed of two pneumatic tires 3, but, depending on the case, it will be possible to have a single pneumatic tire, or three, or even more, and the above mentioned coating (7 in this Figure) will cover the pneumatic tire or tires. It should be noted that in this stack of units, the notches 8 are provided for the passage of a linear element, such as a chain whose links are formed by the wires of the tires between two adjacent units 6.

FIG. 3 shows the preferred barrier whose flexible casing consists of three units, each unit comprising two penumatic tires. This barrier is made in the following manner: the first unit is placed on the ground, the linear element is then placed across the unit in the notches provided therefor. A second unit, likewise provided with notches, is disposed on the first, a new linear element is placed and a third unit is disposed on the two other units. Owing to the various notches, a smooth cylinder made up of the three units mentioned above and traversed by the two linear elements is obtained.

The material defined in paragraph (e) above is then poured within this assembly.

Thus, while maintaining the advantages of the barrier described in the above U.S. patent, the improvements set forth in the present application allow the absorption capacity of the shocks and the flexibility of the modules to be increased. Moreover, any ejection of the debris from fragments of a burst module is rendered impossible by the casing described earlier.

If the coating or covering of fine powder (pulverized rubber+binder) should disintegrate, this would only produce a fine powder not constituting a hazard to motorists.

Other advantages and characteristics of the safety barrier described in U.S. Pat. No. 4,062,521 are again found in this application, particularly with respect to the arrangement of the various modules which are not tied down to the ground and the linear element or elements embedded in the mass of the said modules and which are tied down to the ground, from place to place, so as to hold the said barrier in the proper position.

It goes without saying that it is possible to form a casing otherwise than with pneumatic tires, but this solution is preferred, because it results in lower cost and allows one to dispose of used tires, which are difficult to destroy.

I claim:

1. A safety barrier comprising a plurality of modules coupled to one another by at least one embedded linear element under tension, said modules each being composed of an integral material subject to bursting as a result of internal tension due to said linear element passing through the modules and embedded therein so that any module struck by a car involved in an accident bursts together with adjacent modules and a flexible casing surrounding each module and preventing ejection of debris and fragments of materials upon impact and bursting of the module.

2. The safety barrier of claim 1 wherein the casing comprises a stack of pneumatic tires.

3. The safety barrier of claim 2, wherein said stack includes at least two separate superimposed units, and each unit has at least two pneumatic tires.

4. The safety barrier of claim 3, wherein said units are three in number and each unit has two pneumatic tires.

5. The safety barrier of claims 3 or 4, wherein said casing includes a pneumatic tire located within said stack.

6. The safety barrier of claims 2 or 3, wherein said casing includes an external cover of pulverized rubber and plastic binder.

7. The safety barrier of claim 6, wherein said cover is cast around said tires.

8. The safety barrier of claim 6, wherein said casing and said cover are provided with openings to allow the introduction of the linear element.

9. A safety barrier comprising a plurality of modules coupled to one another by at least one linear element under tension, said modules each being composed of a material bursting as a result of internal tension due to said linear element passing through the modules and embedded therein so that any module struck by a car involved in an accident bursts together with adjacent modules and a flexible casing surrounding each module and preventing ejection of debris and fragments of materials upon impact of a module, wherein the casing comprises a stack of pneumatic tires, and wherein said casing includes a pneumatic tire located within said stack.

10. A safety barrier comprising a plurality of modules coupled to one another by at least one linear element under tension, said modules each being composed of a material bursting as a result of internal tension due to said linear element passing through the modules and embedded therein so that any module struck by a car involved in an accident bursts together with adjacent modules and a flexible casing with an external cover surrounding each module and preventing ejection of debris and fragments of materials upon impact of the module.

* * * * *